US012152452B2

(12) United States Patent
Crawford

(10) Patent No.: US 12,152,452 B2
(45) Date of Patent: Nov. 26, 2024

(54) SEALED CONNECTION FOR MULTIPLE-SECTION TOOL DEPLOYMENT IN LIVE WELLS

(71) Applicant: ZiLift Holdings, Ltd., Dyce (GB)

(72) Inventor: Calum Crawford, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/294,654

(22) PCT Filed: Jul. 28, 2022

(86) PCT No.: PCT/EP2022/071228

§ 371 (c)(1),
(2) Date: Feb. 2, 2024

(87) PCT Pub. No.: WO2023/012031

PCT Pub. Date: Feb. 9, 2023

(65) Prior Publication Data

US 2024/0271498 A1 Aug. 15, 2024

Related U.S. Application Data

(60) Provisional application No. 63/228,286, filed on Aug. 2, 2021.

(51) Int. Cl.
*E21B 23/04* (2006.01)
*E21B 43/12* (2006.01)

(52) U.S. Cl.
CPC ..... *E21B 23/042* (2020.05); *E21B 43/128* (2013.01)

(58) Field of Classification Search
CPC ..... E21B 23/042; E21B 43/128
See application file for complete search history.

(56) References Cited

U.S. PATENT DOCUMENTS

| | | | | |
|---|---|---|---|---|
| 5,617,926 | A * | 4/1997 | Eddison | E21B 23/006 175/61 |
| 6,039,115 | A * | 3/2000 | Mills | E21B 43/126 188/82.1 |
| 6,155,344 | A | 12/2000 | Myers, Jr. et al. | |
| 7,481,283 | B2 | 1/2009 | McDonald et al. | |
| 10,036,210 | B2 | 7/2018 | MacClean et al. | |
| 2002/0179305 | A1 | 12/2002 | Mack et al. | |
| 2003/0183388 | A1* | 10/2003 | Toulouse | E21B 7/061 166/117.6 |

(Continued)

OTHER PUBLICATIONS

ISRWO from the Parent Patent Application PCT/EP2022/071228 issued Nov. 8, 2022.

(Continued)

*Primary Examiner* — Shane Bomar
(74) *Attorney, Agent, or Firm* — Jeffrey D. Frantz

(57) ABSTRACT

Disclosed is a multiple segment well tool (10), the multiple segment well tool comprising a first tool segment having a first shaft (32) rotatably supported in a first tool segment housing (30-1); a connector housing (30A) releaseably connected at one end to one end of the first tool segment housing, and a second tool segment housing (30-2) releaseably connected at one end to another end of the connector housing. The connector housing comprises a piston (34) disposed therein, the piston movable along a longitudinal dimension of the connector housing.

17 Claims, 9 Drawing Sheets

(56) References Cited

U.S. PATENT DOCUMENTS

| | | | | |
|---|---|---|---|---|
| 2009/0202371 | A1 | 8/2009 | Green | |
| 2010/0252252 | A1* | 10/2010 | Harris | E21B 23/04 166/120 |
| 2011/0171047 | A1 | 7/2011 | Parmeter | |
| 2011/0308784 | A1* | 12/2011 | Ollerenshaw | E21B 17/06 166/181 |
| 2013/0098632 | A1 | 4/2013 | Metzel | |
| 2017/0234081 | A1* | 8/2017 | Kirkhope | E21B 17/021 166/378 |
| 2017/0234321 | A1 | 8/2017 | Meyer | |
| 2020/0150751 | A1 | 5/2020 | Laaksonen et al. | |

OTHER PUBLICATIONS

IPRP from the Parent Patent Application PCT/EP2022/071228 issued Feb. 15, 2024.

* cited by examiner

SEALED CONNECTION FOR MULTIPLE-SECTION TOOL DEPLOYMENT IN LIVE WELLS

CROSS-REFERENCE TO RELATED APPLICATIONS

This application is the National Stage Entry of International Application No. PCT/EP2022/071228, filed Jul. 28, 2022, which claims the benefit of U.S. Provisional Application No. 63/228,286, filed Aug. 2, 2021.

FIELD

The present disclosure relates to the field of subsurface well tools that are deployed into 'live' subsurface wells, and associated methods.

BACKGROUND

Described are well tools that are deployed in 'live' subsurface wells, that is, wells that are hydraulically connected to subsurface reservoir formations capable of moving fluid under pressure into such wells. More specifically, the present disclosure relates to connections for joining together adjacent sections of multiple-section well tools in order to enable open air connection and disconnection of adjacent tool segments. "Open air" connection means that part of the tool assembly may be disposed within the well below a well pressure control device during tool deployment and recovery, while the segments to be connected or disconnected are disposed above such well pressure control device and are exposed to open atmosphere.

Some tools used in subsurface wells, e.g., oil and gas wells, are assembled in by connecting segments end-to-end to form an assembled tool "string." Such tool strings may be several tens of meters in length when fully assembled, and individual segments may be on the order of 3 to 10 meters in length. In order to deploy such tool strings in a well, it is necessary to suspend the tool string over the well, subsequently lowering the tool string into the well. Suspending the tool string may be performed by suspending a sheave wheel or coiled tubing guide roller at a selected elevation above the top of the well. In order to minimize the required suspension height, it is known in the art to assemble certain tool strings in segments, wherein an assembled portion of the tool string is locked in place proximate the top of the well, and part of the string may protrude above the well for subsequent connection of an additional segment, and lowering the assembly to a convenient height for connection of one or more additional tool segments.

When a well is completed, that is, hydraulically connected to a fluid producing formation, as a matter of safety, any further intervention in the well is conducted through a pressure control device, called a blowout preventer (BOP). A BOP includes various types of seals and closure elements that may be operated to close the well to prevent uncontrolled escape of fluid from the well. When well tools are deployed in a completed well, a device called a "lubricator" is assembled to the top of the BOP. A lubricator is a conduit suspended over and connected to the BOP at one end, and which has a cable or tubing pass-through seal at its other end. Deployment of a well tool comprises inserting the well tool into the lubricator conduit, suspending the lubricator and tool over the BOP, connecting the lubricator to the BOP, and then opening the seals and closure elements in the BOP to enable moving the well tool into the well.

Long well tools and tool strings ordinarily require corresponding length lubricators for deployment in live, completed wells. Such long lubricators require corresponding lifting apparatus, and require suitable vertical clearance over the BOP. Segmented well tool strings may be assembled over the well, however, in the case of live wells, such assembly is not feasible. It is known in the art to retrieve well tools known as perforating guns from a live well. U.S. Pat. No. 6,155,344 issued to Myers, Jr. et al. discloses an apparatus for enabling disassembly of segmented perforating guns from a live well while maintaining the ability to close the well to fluid flow. Such apparatus is unsuitable for use with certain types of well tools that include rotating shafts, such as electric submersible pumps (ESPs) or tool strings that are assembled and disassembled by rotating certain interconnecting devices.

Accordingly, there is a need for a device to enable deployment of certain types of segmented well tools that can be used with rotating devices.

SUMMARY

Disclosed is a multiple segment well tool, which has a first tool segment including a first shaft rotatably supported in a first tool segment housing. A connector housing is releaseably connected at one end to one end of the first tool segment housing. A second tool segment housing is releaseably connected at one end to another end of the connector housing. The connector housing comprises a piston disposed therein which is movable along a longitudinal dimension of the connector housing. The piston comprises internal splines at one end for receiving splines on an exterior of the first shaft. The piston comprises a seal on a face engageable with a shoulder in the connector housing to close the connector housing to fluid flow. The piston comprises internal splines at another end for receiving splines on a second shaft rotatably supported in the second tool segment. The piston comprises a spring in the internal splines in the other end whereby coupling the second tool segment to the connector housing causes the second shaft in the second tool segment to compress the spring to move the piston and disengage the seal.

Some examples may further comprise a lock screw disposed through a wall of the connector housing, the lock screw engageable with a groove formed on an exterior surface of the piston, whereby engagement of the lock screw with the piston restrains the piston longitudinally to engage the seal with the shoulder.

Some examples may further comprise a fluid passage in an interior of the connector housing on one side of the piston extending to the interior of the housing on another side of the piston, the fluid passage comprising a valve to enable selective fluid connection of the one side of the piston to the other side of the piston.

Some examples may further comprise a connector disposed between the connector housing and the second tool segment, the connector comprising opposed handed threads on opposed longitudinal ends to enable coupling the second tool segment to the connector housing by rotation of the connector.

In some examples, the first tool segment may comprise a well pump.

In some examples, the second tool segment may comprise a well pump protector.

In some examples, the connector housing may comprise a feature on an exterior surface for engagement with a closure element in a well pressure control device.

A pressure control sub for a multiple component well tool includes a connector housing having a connection feature to enable releasable connection at one end to one end of a first tool segment. The connector housing has a connection feature to enable releasable connection at another end to a second tool segment. The connector housing comprises a piston disposed therein that is movable along a longitudinal dimension of the connector housing. The piston comprises internal splines at one end for receiving splines on an exterior of a first shaft in the first tool segment. The piston comprises a seal on a face engageable with a shoulder in the connector housing to close the connector housing to fluid flow. The piston comprises internal splines at another end for receiving splines on a second shaft rotatably supported in the second tool segment. The piston comprises a spring in the internal splines in the other end whereby coupling the second tool segment to the connector housing causes the second shaft in the second tool segment to compress the spring to move the piston and disengage the seal.

Some examples further may comprise a lock screw disposed through a wall of the connector housing, the lock screw engageable with a groove formed on an exterior surface of the piston, whereby engagement of the lock screw with the piston restrains the piston longitudinally to engage the seal with the shoulder.

Some examples may further comprise a fluid passage in an interior of the connector housing on one side of the piston extending to the interior of the housing on another side of the piston. The fluid passage comprises a valve to enable selective fluid connection of the one side of the piston to the other side of the piston.

Some examples may further comprise a connector disposed between the connector housing and the second tool segment. The connector comprises opposed handed threads on opposed longitudinal ends to enable coupling the second tool segment to the connector housing by rotation of the connector.

In some examples, the first tool segment may comprise a well pump.

In some examples, the second tool segment may comprise a well pump protector.

In some examples, the connector housing may comprise a feature on an exterior surface for engagement with a closure element in a well pressure control device.

Further described is a method for deploying a multiple segment well tool in a well. This method includes disposing a first tool segment of the well tool in a lubricator. The first tool segment has a pressure control sub coupled to one end. The pressure control sub comprises a connector housing having a connection feature to enable releasable connection at one end to the one end of the first tool segment. The connector housing has a connection feature to enable releasable connection at another end to a second tool segment. The connector housing comprises a piston disposed therein movable along a longitudinal dimension of the connector housing. The piston comprises internal splines at one end for receiving splines on an exterior of a first shaft in the first tool segment. The piston comprises a seal on a face engageable with a shoulder in the connector housing to close the connector housing to fluid flow. The piston comprises internal splines at another end for receiving splines on a second shaft rotatably supported in the second tool segment. The piston comprises a spring in the internal splines in the other end whereby coupling the second tool segment to the connector housing causes the second shaft in the second tool segment to compress the spring to move the piston and disengage the seal. The lubricator is coupled to a well pressure control device. The first tool segment is moved until the pressure control sub is disposed in the well pressure control device. A closure element in the well pressure control device is operated. The lubricator is removed from the well pressure control device. The second tool segment is disposed to enable retraction into the lubricator. The lubricator is lifted above the well pressure control device and is extended so that the second tool segment is above the pressure control sub. The second tool segment is coupled to the pressure control sub. The lubricator to the well pressure control device; and the closure element is opened.

Some examples may further comprise moving the first tool segment, the pressure control sub and the second tool segment to a predetermined depth in the well.

Some examples may further comprise: moving the first tool segment, the pressure control sub and the second tool segment from the predetermined depth so that the pressure control sub is disposed in the closure element; operating the closure element; lifting the lubricator from the pressure control device; uncoupling the second tool segment from the pressure control sub; coupling the lubricator to the pressure control device; opening the closure element; and moving the pressure control sub and the first tool segment into the lubricator.

Other examples and possible advantages will be apparent from the description and claims that follow.

DETAILED DESCRIPTION

Figure 1:
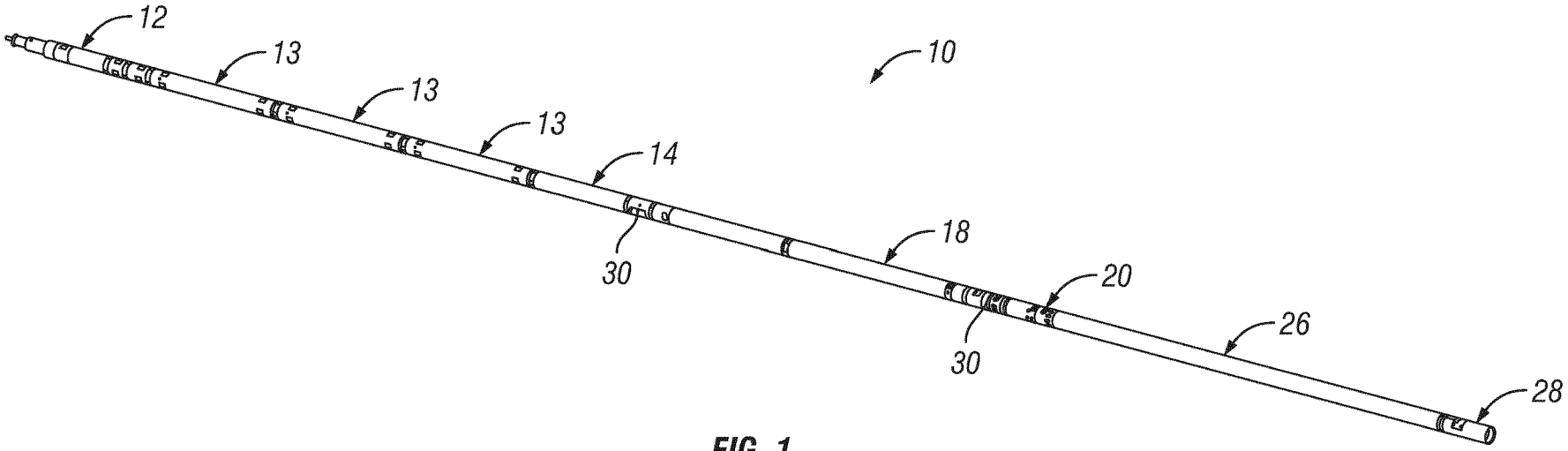
FIG. 1 shows a well tool such as an electric submersible pump (ESP) that may have components of a pressure control sub.

FIG. 1 shows a well tool 10 that may be assembled by interconnecting end to end a plurality of tool segments, to be explained in more detail below. The well tool 10 is intended for deployment in a well (see FIG. 10) as a tool assembly or "string" with the segments interconnected as the well tool 10 is lowered into the well. In some examples, the well tool 10 may be an electric submersible pump (ESP). ESPs are sold, for example by ZiLift Ltd., Aberdeen, GB, the assignee of the present disclosure. The ESP may be, for example and without limitation, of a type that can be deployed in a well on an electrical cable. See, for example, U.S. Pat. No. 10,036,210 issued to Maclean et al. and assigned to the assignee of the present disclosure. A method for deploying a well tool such as an ESP as disclosed in the '210 patent may find particular advantage when using a method and apparatus according to the present disclosure, however it is to be clearly understood that the particular type of well tool, or ESP, and the manner of conveyance or deployment in a well are not limitations on the scope of the present disclosure.

Figure 2:
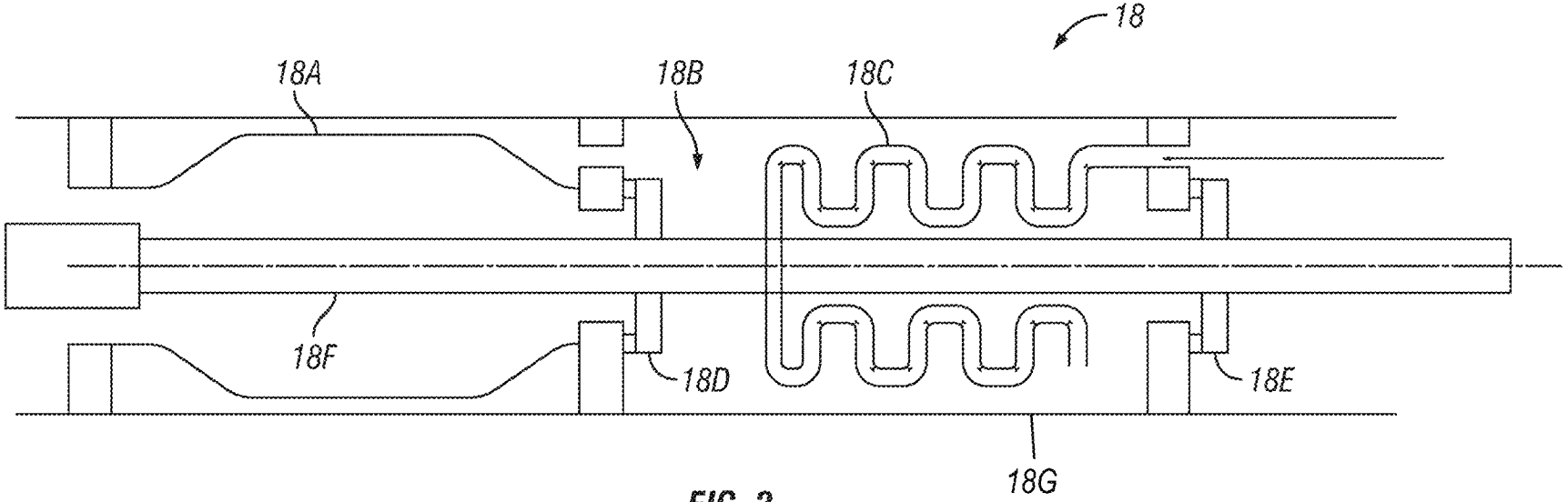
FIG. 2 (Prior Art)
FIG. 2 shows a labyrinth seal used in a protector section of an ESP such as in FIG. 1 to illustrate how well fluid may be excluded from a motor section of the ESP.

The well tool (e.g., ESP) 10 may comprise a cable connector 12 to couple the uppermost end of the well tool 10 to a deployment cable (not shown) or other tool conveyance device, e.g., jointed tubing, coiled tubing or slickline, used to extend the well tool 10 into a well (FIG. 10) and to retrieve the well tool 10 when desired. The cable connector 12 may be coupled to a motor 13, e.g., an electric motor, used to operate a pump 26 disposed proximate the lower end of the well tool 10. A monitoring sensor sub 14 may be coupled to an opposed end of the motor 13, and may comprise one or more sensors (not shown separately) for measuring operating parameters of the well tool 10, e.g., in the case of a pump, well fluid pressure, temperature and rotation speed of the pump 26, among other parameters. The pump 26 may be coupled to an opposed end of the monitoring sensor sub 14 and may comprise an intake 28 and discharge 20 for induction and discharge, respectively, of well fluid that is lifted by the pump 26. A protector/seal section 18 ("protector" hereinafter for convenience), to be explained in more detail with reference to FIG. 2, provides an enclosure for a drive shaft (FIG. 2) that extends functionally from the monitoring sensor sub 14 to the pump 26, and provides a mechanism to exclude well fluid under pressure from entering the segments of the well tool 10 from which well fluid should be excluded, such as the motor 13, the cable connector 12 and the monitoring sensor sub 14. Although the well tool 10 is shown with the motor 13 disposed above (with reference to the surface end of the well tool 10 as deployed in the well) the pump 26 may be disposed above the motor 13. Irrespective of relative placement of the motor 13 and the pump 26, the protector 18 performs the same function, that is, to exclude well fluid from entering the motor 13 (and in FIG. 1, the monitoring sensor sub 14), while providing passage for a drive shaft (FIG. 2). The motor 13 may be directly rotationally coupled to such drive shaft (FIG. 2) or may be functionally rotationally connected through a gear set (not shown) to provide suitable rotary speed and torque to the pump 26. See, for example, U.S. Pat. No. 7,481,283 issued to McDonald et al. which describes a non-limiting example of such a gear set.

As may be inferred by observing FIG. 1, the well tool 10 may be quite long, such as several tens of meters in length. In order to reduce the length of a well pressure control conduit, that is, a "lubricator" (not shown) to be connected to the top of a well, as will be further explained with reference to FIGS. 10 and 11, and to reduce the amount of vertical clearance needed above a well to enable deployment of the lubricator and the well tool 10, the well tool 10 may be assembled during deployment from segments, for example, by having connections between the protector 18 and the pump 26 and/or between the protector 18 and the monitoring sensor sub 14. Location of connections between the foregoing components is provided only as an example and is not intended to limit the scope of the present disclosure; locations of connections may be at any convenient places along the length of the well tool 10 depending on the lengths of the individual segments that constitute the well tool 10. To enable assembly and disassembly of the well tool 10 at such connections while part of the well tool 10 is disposed in the well, a sealed connection, called a pressure control sub 30, may be coupled within the well tool 10 at one or more locations along the length of the well tool 10, such as shown in FIG. 1.

The pressure control sub 30 may be provided as a separate device that may be assembled to existing segments of a well tool without modifying such segments from the form they have without the use of the pressure control sub 30, or the functional components of the pressure control sub 30 may be added to provide a modified form of one or more the respective well tool segment(s).

An example of the protector 18 is shown in more detail in FIG. 2. The protector 18 may comprise functional components disposed in a pressure resistant housing 18G. The previously described drive shaft, shown at 18F, may pass longitudinally through the housing 18G. A longitudinal end of the protector 18 in the direction of the pump (26 in FIG. 1) may be exposed to well fluid at ambient well pressure. As explained with reference to FIG. 1, such longitudinal end and the corresponding position of the pump may be above or below the motor. A first rotary seal 18E such as a face seal may be disposed in the housing 18G in the direction of the pump, through which the driveshaft 18F passes toward the opposite longitudinal end (the motor end) of the housing 18G. The first rotary seal 18E may be disposed to one side of a first chamber or bag 18B, which may have therein a labyrinth tube 18C that allows fluid movement, and thus pressure communication, across the first rotary seal 18E, but minimizes mixing of well fluid with motor oil by capillary pressure. A second chamber or bag 18A may enclose the driveshaft 18F between a second rotary seal 18D, e.g., a face seal, and a motor end of the first chamber or bag 18B. The second chamber or bag 18A is in pressure communication with the first chamber or bag 18B, and is initially filled with dielectric fluid, e.g., motor oil, and is open at the motor end. Thus, well fluid pressure is readily communicated to the second chamber or bag 18A, yet well fluid is substantially excluded from entering the second chamber 18A and thus the motor (13 in FIG. 1). It will be appreciated that the pressure control sub (30 in FIG. 1) may be advantageously located at the connection between the protector 18 and the pump (26 in FIG. 1) although such location is not intended to limit the scope of the present disclosure.

It will also be appreciated that the well tool (10 in FIG. 1), when fully assembled as shown in FIG. 1, is capable of excluding fluid under pressure from traversing the well tool 10 when the well tool 10 is held within a seal assembly (e.g., a blowout preventer—"BOP" 50 in FIG. 10) proximate the top of the well. Thus, as assembled, part of the well tool 10 could protrude from a well (see FIG. 10) while maintaining pressure integrity within the well below. However, disassembling one or more segments from the well tool 10, such as at either end of the protector 18 may provide a path for fluid pressure to escape, such that disassembly of a conventional well tool is unsafe when the well tool 10 partially protrudes from the well. The pressure control sub 30 (or inclusion of the functional components thereof in various segments of the well tool) is intended to enable such assembly and disassembly of the well tool 10, wherein part of the well tool 10 protrudes from the well while such tool part is exposed to open air.

Figure 3:
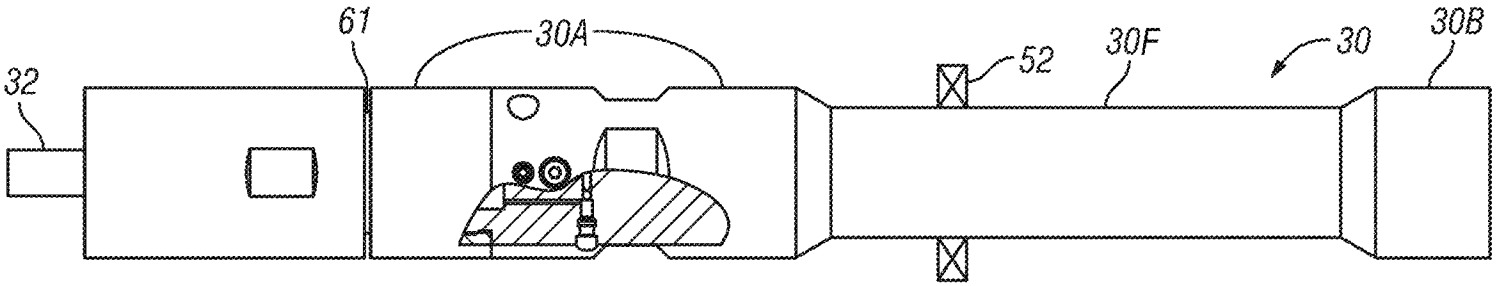
FIG. 3 shows a partial view of two segments of the ESP system of FIG. 1 to illustrate connection between segments that may enable assembly while part of the well tool is disposed in a well.
Figure 4:
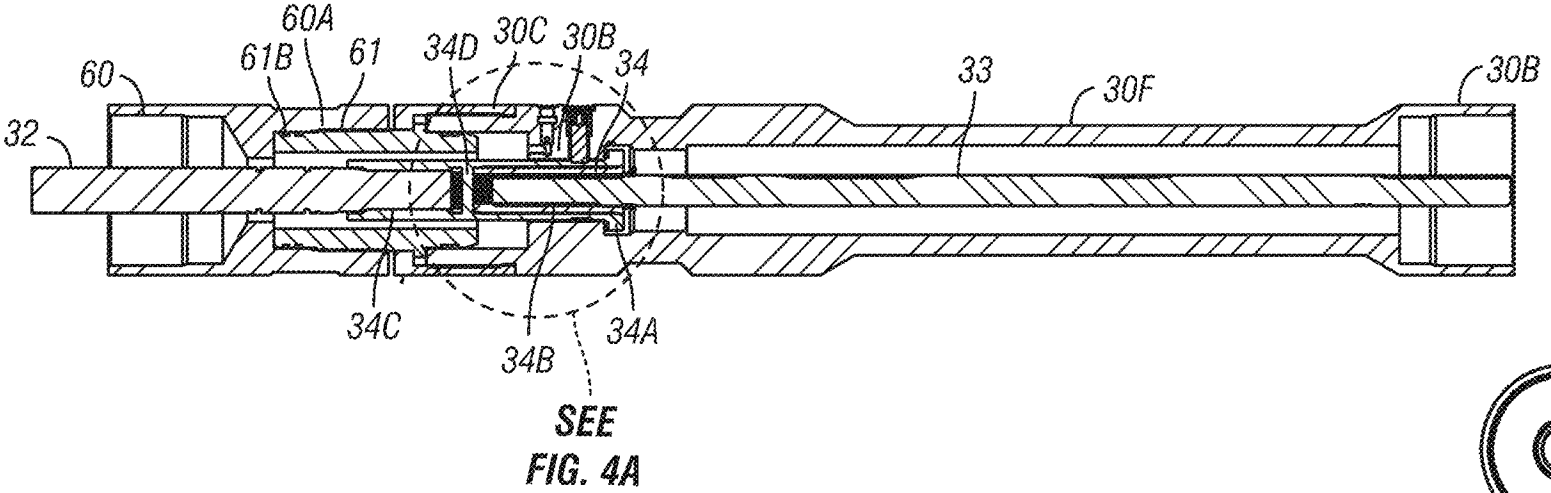
FIG. 4 shows a cross-sectional view of the example shown in FIG. 3 to illustrate some of the functional components used to seal the part of the well tool disposed in the well during assembly and disassembly of segments above such part of the well tool.
Figure 4A:
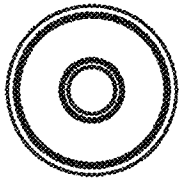
FIG. 4A shows a sectional view from a top view perspective of the functional components located in the encircled section in FIG. 4.

A pressure control sub 30 which may be disposed at a connection between two adjacent well tool segments, is shown in side view in FIG. 3 and in cross-sectional view in FIG. 4. Functional components of the pressure control sub 30 may be disposed in a pressure resistant connector housing 30A. Such connector housing 30A may form part of the housing enclosing a part or a segment of the well tool (10 in FIG. 1), for example and without limitation, the pump (26 in FIG. 1); in some examples the connector housing 30A may be a separate device from the housing of such segment of the well tool (10 in FIG. 1). The connector housing 30A has features, e.g., threads, used to make connection between two adjacent well tool segments, irrespective of whether the connector housing 30A is integral with the housing for one of the two connected well tool segments or the connector housing 30A is an entirely separate housing from the housings of each of two adjacent connected well tool segments.

The connector housing 30A may include at one longitudinal end a connection 60, such as a threaded connector, to enable coupling the connector housing 30A to an adjacent portion of the well tool, e.g., the protector housing (18G in FIG. 2). The connector housing 30A may comprise a connector e.g., a threaded connection 30B at its other longitudinal end for coupling to corresponding threaded connection (not shown) on an adjacent segment of the well tool (10 in FIG. 1). Rotary motion from a part of the driveshaft (see 18F in FIG. 2) in an adjacent segment of the well tool (10 in FIG. 1) may be communicated through a first driveshaft segment 32. When the pressure control sub 30 is fully assembled, the first driveshaft segment 32 may be rotationally coupled to a second driveshaft segment 33.

The connector housing 30A may comprise a smooth or "slick" external surface 30F for engagement with closure elements such as rams or an annular seal in a well pressure control device such as a BOP (see FIG. 10) during assembly and disassembly of the well tool (10 in FIG. 1) as will be further explained below.

A piston 34 may be disposed in a corresponding bore 30B in the connector housing 30A. The piston 34 may comprise a seal shoulder 34A that stops movement of the piston 34 against an internal shoulder (see 30C in FIG. 6) and thereby activates a seal (37 in FIG. 6) when the piston 34 is in contact with the shoulder (30C in FIG. 6). The piston 34 comprises a first internal spline section 34C shaped and sized to receive corresponding splines on an exterior of the first driveshaft segment 32, thereby enabling relative longitudinal movement between the first driveshaft segment 32 and the piston 34, while transmitting rotary motion (torque) between the first driveshaft segment 32 and the piston 34. The piston 34 may comprise a second internal spline section 34B to correspondingly engage splines on the exterior of the second driveshaft segment 33. The first internal spline segment 34C and the second internal spline segment 34B may be separated by an internal barrier 34D such that when the piston 34 seals against the shoulder (30C in FIG. 6), fluid pressure cannot move through or across the piston 34.

When the connection 60 is open, that is, when there is no adjacent tool segment (not shown in FIG. 3 and FIG. 4 for clarity of the illustration), e.g., the protector 18, connected to the connector 30, the piston 34 may be urged or biased toward the first driveshaft segment 32.

The connection 60 may be attached to the adjacent tool segment (e.g., the protector) prior to assembly of the pressure control sub 30. The adjacent tool segment (not shown) may thereby have as its free longitudinal end a coupling part 60A of the connection 60. The connector housing 30A may have a housing connector 30C disposed on its longitudinal end toward the connection 60. The connection 60 may be attached to the housing connector 30C by a double ended coupling 61. The double ended coupling 61 may comprise seals 61B to engage corresponding portions of the connection 60 and the housing connector 30C. The double ended coupling 61 may comprise opposed-handed thread sections to engage corresponding threaded portions of the housing connector 30C and the connection 60, whereby rotation of the double ended coupling 61 simultaneously engages or disengages corresponding threads on the connector and the housing connector 30C. In this way, simple rotation of the double ended coupling 61 can connect or disconnect the connector housing 30A from the connection 60.

Figure 5:
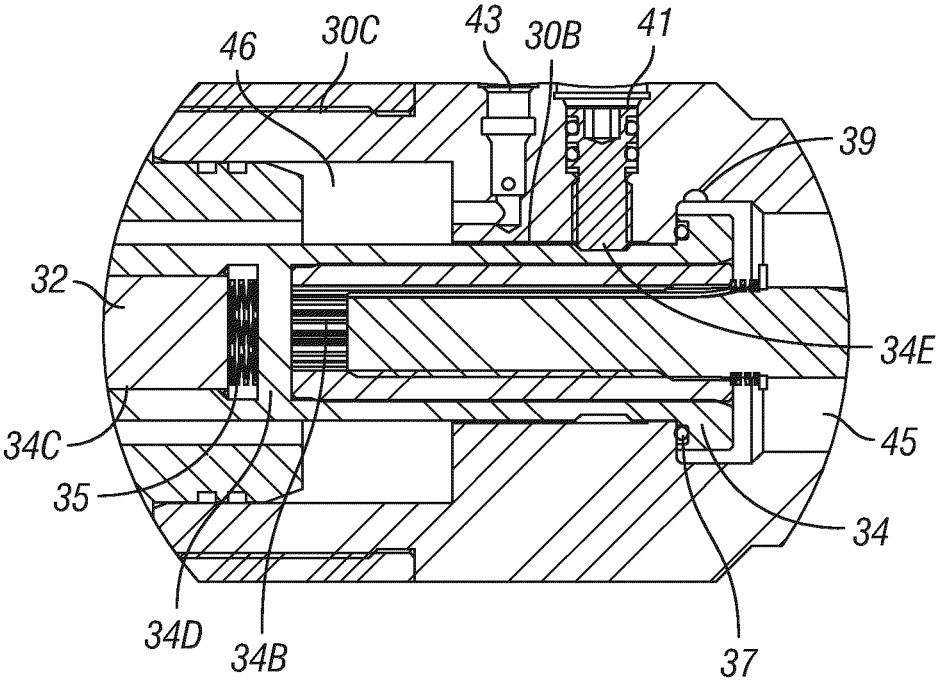
FIG. 5 and FIG. 6 show, respectively, enlarged views of the functional components of FIG. 3 in the sealed (FIG. 5) and open (FIG. 6) positions.
Figure 9:
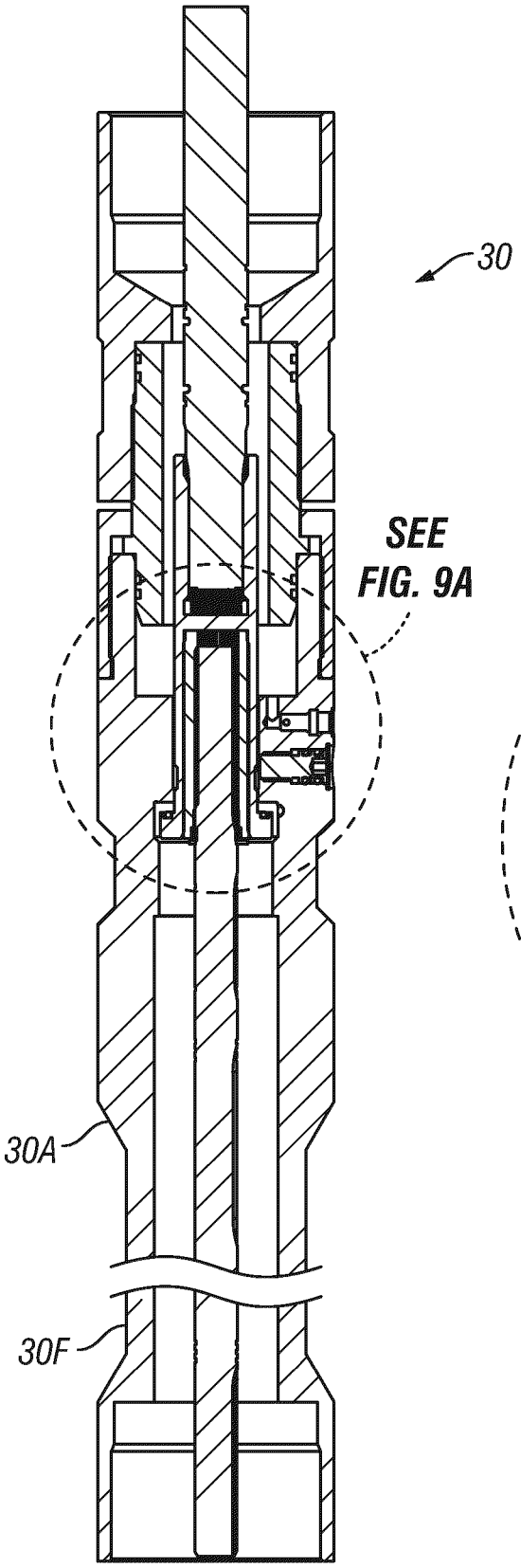
FIG. 9 shows the assembled tool segments as in FIG. 8 after the lockdown screw is released and pressure is released from the sealed tool segment.

Referring to FIG. 5, and as explained above, when the housing connector 30C is disengaged from the connection 60, urging the piston (e.g., by a spring) places the piston 34 proximate the shoulder 30C in the connector housing 30A, and activates a seal 37, such as an O-ring, to close the interior of the connector housing 30A to fluid flow from the interior of the connector housing 30A (shown at 45 in FIG. 5) in the direction of the housing connector 30C. Such interior 45 may comprise a pressure equalization port 39 that selectively fluidly connects (e.g., using a valve) to a space 46 between the piston 34 and the double ended coupling 61. The space 46 may be selectively vented to the external environment when needed through a block and bleed port 43 in the connector housing 30A. When the piston 34 is in the position shown in FIG. 5, one or more lockdown screws 41 may be rotated to engage a corresponding recess 34E on the exterior surface of the piston 34. The lockdown screw(s) 41 may prevent inadvertent movement of the piston 34 while the pressure control sub 30 is exposed above the BOP (50 in FIG. 10) and the well tool is partially disposed in the well (FIG. 9). The lockdown screw(s) 41 may also further urge the piston 34 into contact with the shoulder 30C when the lockdown screws 41 are engaged.

Figure 6:
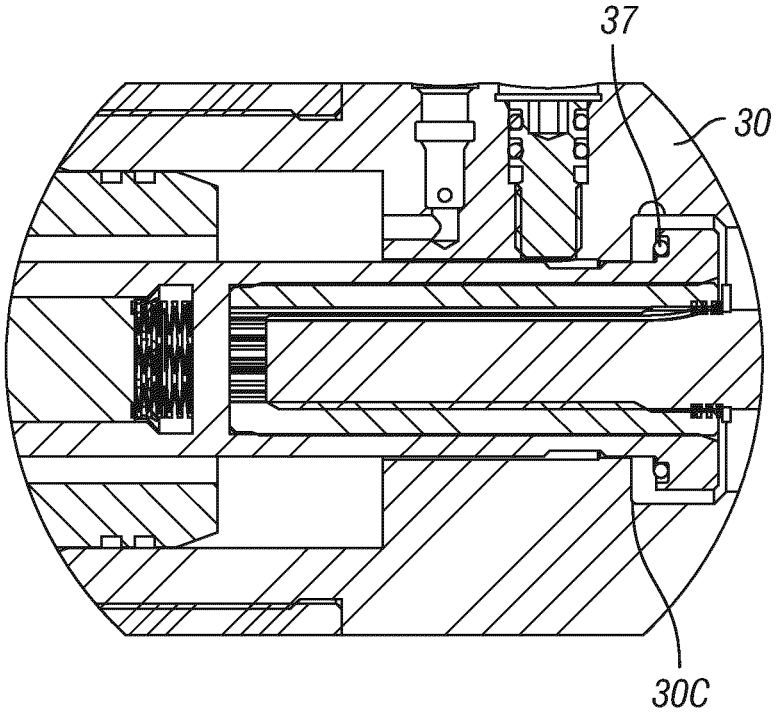

Referring to FIG. 6, when the adjacent well tool segments are assembled, axial movement of the first driveshaft segment 32 into the first internally splined segment 34C ultimately results in the first driveshaft segment contacting a spring 35 inside the first internally splined segment 34C. The spring 35 at its other end thus urges the piston 34 away from the first driveshaft segment 32. The lockdown screw(s) 41 may then subsequently be retracted, and the equalization port 39 may then be opened to balance fluid pressure between the interior 45 and the space 46. The spring 35 then urges the piston 34 away from contact with the shoulder 30C. When the piston 34 moves out of contact with the shoulder 30C, well fluid is then free to move from the interior 45 in the direction of the space 46 and the spline coupling between the piston 34 and the driveshaft segment(s) is/(are) moved to a position where it may rotate freely.

Figure 7:
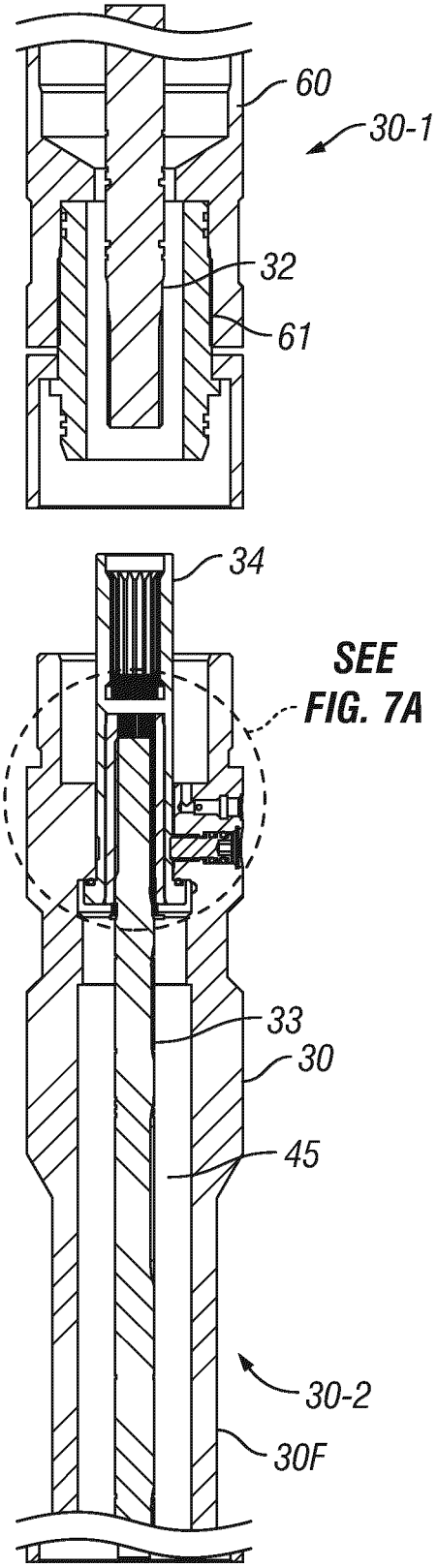
FIG. 7 shows a cross-sectional view as in FIG. 4, but with the segments of the well tool separated from each other.
Figure 7A:
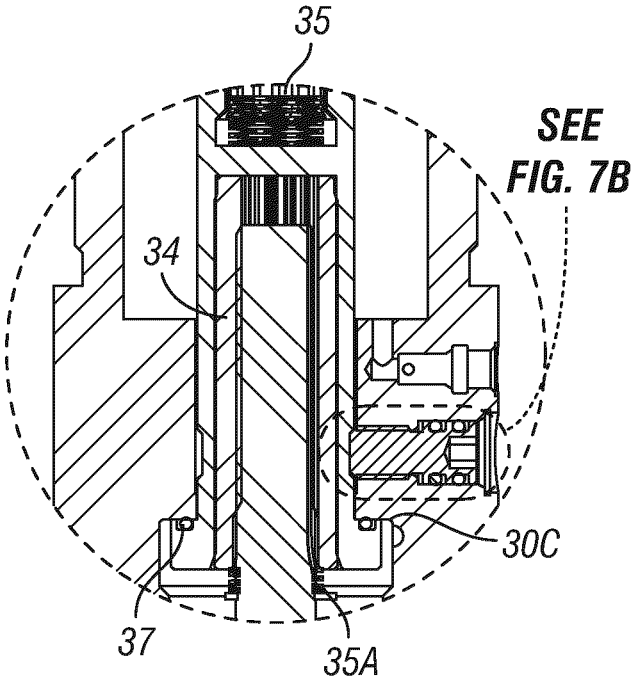
FIG. 7A shows an enlarged sectional view of the segment of the well tool that is pressure sealed for assembly and disassembly while in the well and exposed to well pressure.
Figure 7B:
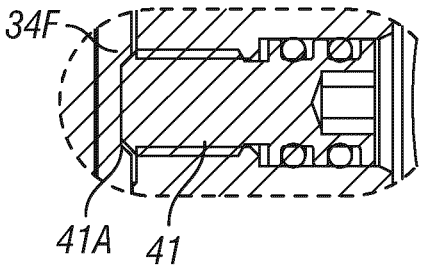
FIG. 7B shows an enlarged view of a lockdown screw in FIG. 7A.

Referring to FIGS. 7, 7A and 7B, a method for assembling and disassembling well tool segments using a pressure control sub according to the present disclosure will be explained in more detail. FIG. 7 shows the pressure control sub 30 separated into a suspended segment 30-1 and an in-well segment 30-2. As will be further explained with reference to FIG. 10, the in-well segment 30-2 may be disposed in a BOP (50 in FIG. 10) at the top of a well, wherein a well closure element (52 in FIG. 10), e.g., a ram or an annular seal forming part of the BOP (50 in FIG. 10), may be closed about the exterior of the connector housing 30A, e.g., on the smooth (or slick) exterior surface 30C. The lockdown screw(s) 41 may be engaged to lock the piston 34 in place such that the piston 34 is in contact with the shoulder 30C. The interior 45 of the connector housing 30A may have fluid therein at well pressure, wherein such fluid is held in place by the piston 34 and the seal 37.

Prior to disposing the in-well segment 30-2 within the BOP (50 in FIG. 10), the piston 34 may be urged into contact with the shoulder 30C by a combination of biasing force provided by a second spring 35A, and by action of engaging the lockdown screw(s) 41. In the detail of FIG. 7C, it may be observed that the lockdown screw(s) 41 may comprise a tapered end 41A to engage a corresponding bevel 34F in the edge of the recess (34E in FIG. 4) on the exterior of the piston 34. Prior to inserting the in-well segment 30-2, and any well tool segments coupled thereto, into the BOP (50 in FIG. 10), pressure integrity of the piston 34 and seal 37 may be tested by applying fluid pressure to the interior 45. Once pressure integrity is verified, the in-well segment 30-2 may be inserted into the BOP (50 in FIG. 10) and the ram or other closure element (52 in FIG. 10) may be closed about the smooth exterior surface 30F.

It will be appreciated by those skilled in the art that the suspended segment 30-1 may be partially disposed inside a lubricator (not shown). The lubricator is itself suspended over the BOP (50 in FIG. 10), and the suspended segment 30-1 may be extended through the open bottom of the lubricator for access to attach the suspended segment 30-1 to the in-well segment 30-2 as explained above. Once the suspended segment 30-1 is connected to the in-well segment 30-2 and pressure integrity is tested, as will be explained further below, the lubricator (not shown) may be lowered and coupled to the BOP (50 in FIG. 10) and such connected lubricator and BOP (50 in FIG. 10) may be pressure tested. Upon confirming pressure integrity of the connected BOP and lubricator, the assembled in-well segment 30-2 and suspended segment 30-1 may be lowered through the BOP (50 in FIG. 10). The lowering may continue until either: (i) to a position where a subsequent smooth exterior surface on another pressure control sub further upward along the exterior surface of the part of the well tool previously disposed within the rams or other closure element (52 in FIG. 10) within the BOP (50 in FIG. 10), or (ii) to the deployment depth in the well of the entire well tool (10 in FIG. 1) if the well tool is at that time fully assembled.

It will be appreciated by those skilled in the art that in order to lower the well tool as explained above, it is first necessary to open the closure element (52 in FIG. 10) in which the well tool is retained. In order to safely open such closure element on a live well, a safety requirement is to have the lubricator fully assembled to the BOP (50 in FIG. 10) or other surface expression of the well. It will also be appreciated that by assembling the well tool in segments as explained herein, the lubricator may be substantially shorter than would be required were the well tool to be deployed when fully assembled.

Figure 8:
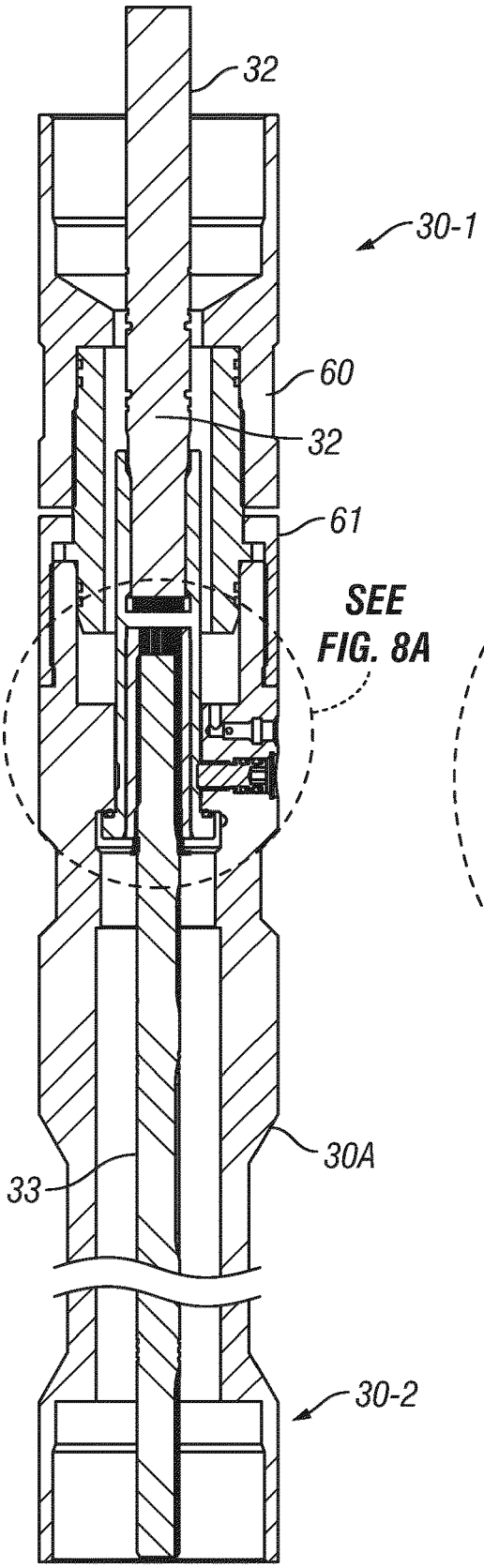
FIG. 8 shows the well tool segments of FIG. 7 interconnected to each other.
Figure 8A:
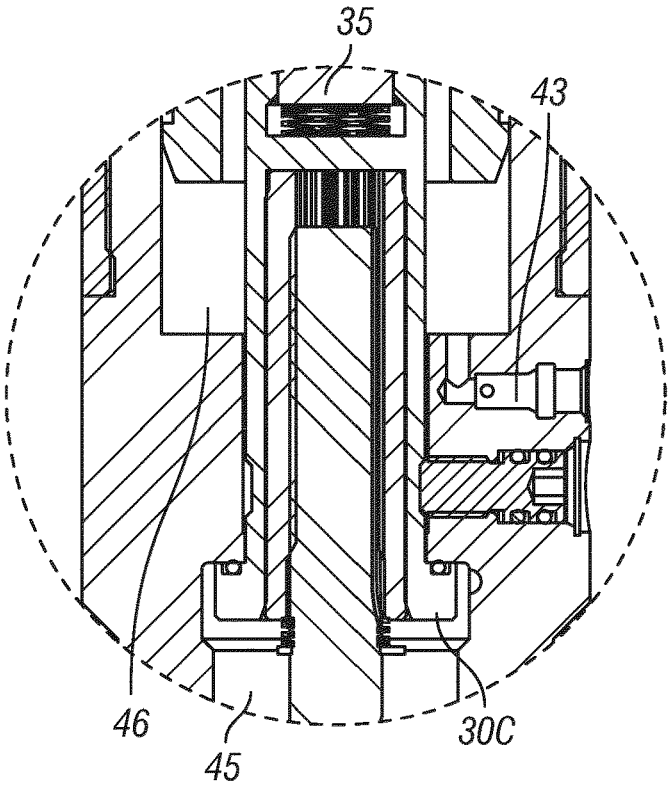
FIG. 8A shows an enlarged view of part of the same segment of the well tool shown in FIG. 7A, but while assembled to the other segment of the well tool as shown in FIG. 8 and the condition of the sealed tool segment prior to seal release.

In FIGS. 8 and 8A, the suspended segment 30-1 is shown lowered onto and assembled to the in-well segment 30-2. Assembly may be performed, for example, by rotating the double ended coupling 61, or any other form of connection depending on the specific connection elements used to couple the in-well segment 30-2 to the suspended segment 30-1. For purposes of this part of the description, it may be presumed that the suspended segment 30-1 has another pressure control sub (not shown) according to FIGS. 3 through 6 at its other longitudinal end (not shown), or otherwise terminates in a pressure resistant form such as in the cable connector (12 in FIG. 1). In such event, pressure integrity of the assembled in-well segment 30-2 and suspended segment 30-1 may be tested by applying fluid pressure to the block and bleed port 43.

Figure 9A:
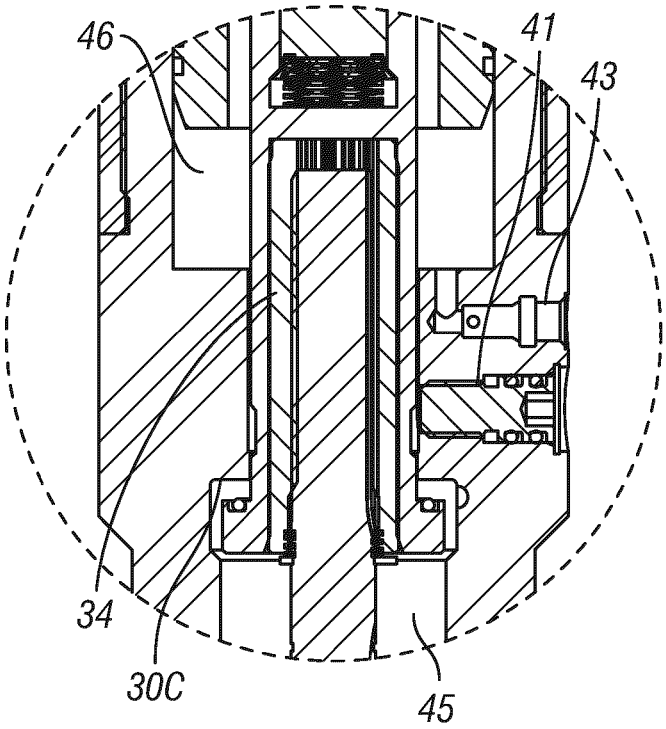
FIG. 9A shows an enlarged view corresponding to FIG. 8A after seal release.

Once pressure integrity of the assembled in-well segment 30-2 and suspended segment 30-1 is verified, and referring to FIGS. 9 and 9A, the pressure equalization port (39 in FIG. 4) may be opened such that the same fluid pressure is then present in the interior 45 and in the space 46. At such time, the lockdown screw(s) 41 may be disengaged from the piston 34. Because the pressure in the space 46 and the interior 45 are equalized, the force exerted by the spring 35 overcomes any biasing force on the piston 34 against the shoulder 30C (whether from the second spring 35A or from other biasing force such as pressure) and causes the piston 34 to move away from the shoulder 30C. When the piston 34 is moved away from the shoulder 30C, fluid pressure may then communicate freely between the interior 45 and the space 46. At such time, the lubricator (not shown) may be coupled to the BOP (FIG. 10), the rams or closure elements in the BOP may be opened, and the assembled in-well segment 30-2 and suspended segment 30-1 may be lowered into the well as explained above.

Figure 10:
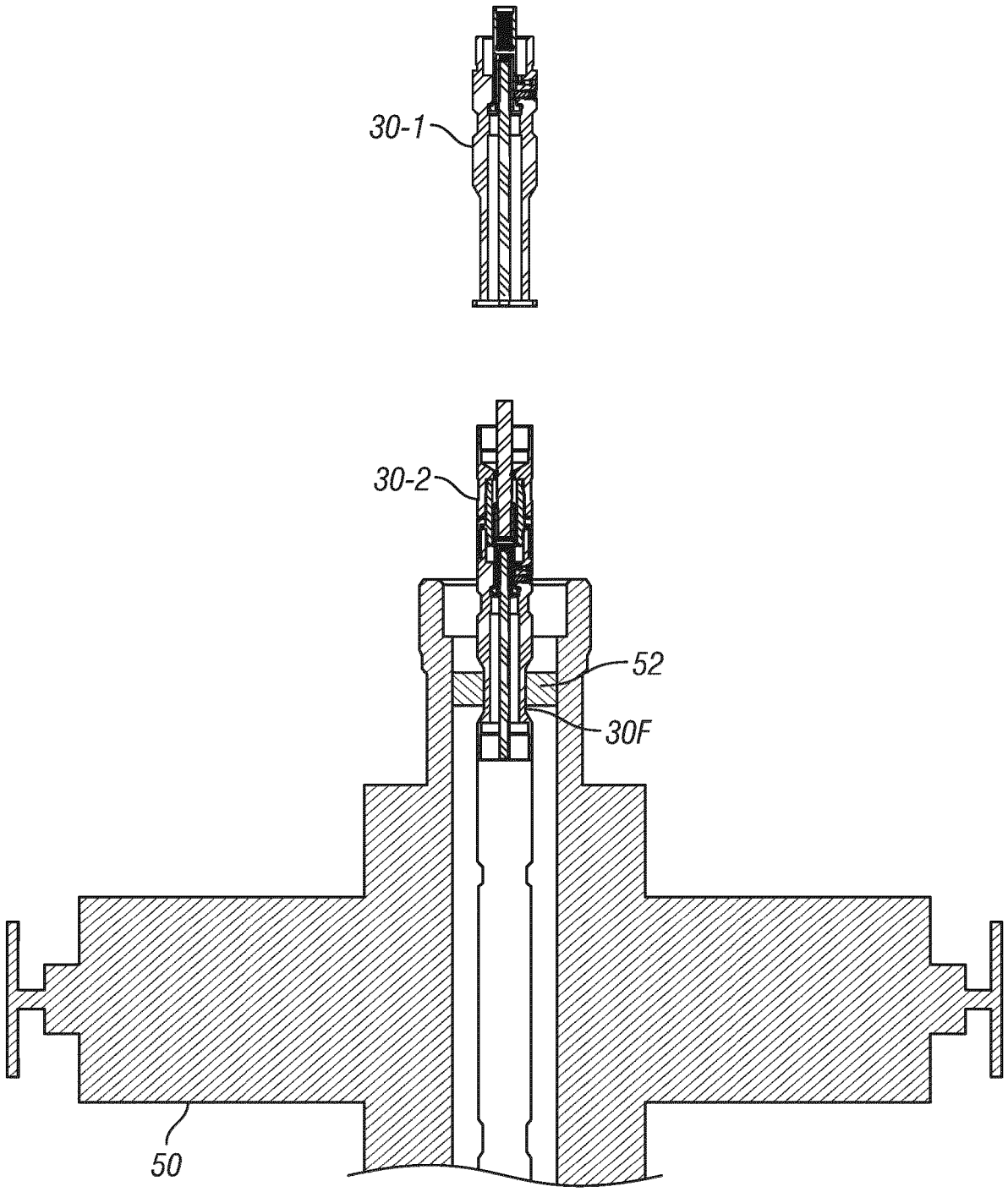
FIG. 10 shows the "in-well" segment of the well tool as in FIG. 7 disposed in well pressure control equipment, such as a blowout preventer (BOP), with the other segment of the well tool suspended above for assembly (or after disassembly) to/(or from) the in-well segment of the well tool.

To retrieve the well tool (10 in FIG. 1) from the well, the well tool is moved (withdrawn from the well) so that the smooth exterior surface 30F is positioned within the rams or other closure element in the BOP (50 in FIG. 10). The rams or other closure elements (52 in FIG. 10) are closed about the smooth surface 30F, and any pressure in the lubricator (not shown) may then be released ("bled off"). The lubricator (not shown) may then be uncoupled from the BOP (50 in FIG. 10) and lifted to expose, from above the BOP (50 in FIG. 10), the connection 60, the double ended coupling 61 and that portion of the connector housing 30A at least to the axial location of the lockdown screws(s) 41.

At such time, the piston 34 may be caused to reengage with the shoulder 30C so as to activate the seal 37. Such reengagement may be effected by bleeding off fluid pressure in the space 46 through the block and bleed port 43 and/or engaging the lockdown screw(s) 41. As explained above, the lockdown screw(s) 41 may comprise a tapered end 41A to engage a corresponding bevel 34F in the edge of the recess (34E in FIG. 4) on the exterior of the piston 34. Thus, engaging the lockdown screw(s) 41 may urge the piston 34 into contact with the shoulder 30C. Pressure integrity of the pressure control sub 30 may then be tested by fully bleeding off pressure through the block and bleed port 43. When pressure integrity is verified, the suspended segment 30-1 may be uncoupled from the in-well segment 30-2.

After the suspended segment 30-1 is disconnected from the in-well segment 30-2, the suspended segment 30-1 may be uncoupled from the conveyance (e.g., the cable connector 12 in FIG. 1). The lubricator (not shown) will then be substantially empty. At such time, the conveyance may then be coupled to the in-well segment 30-2 extending above the BOP (50 in FIG. 10). The lubricator (not shown) may be reconnected to the BOP (50 in FIG. 10) and pressure tested. When pressure integrity is verified, the rams or other closure elements (52 in FIG. 10) may be opened and the in well portion 30-2 withdrawn into the lubricator (not shown).

Depending on the length of the lubricator (not shown) and the components assembled within the in-well segment 30-2, either the entire in-well segment 30-2 may be withdrawn into the lubricator (not shown) or the in-well segment may be lifted so that another pressure control sub is disposed in the rams at its slick exterior surface. If the entire in-well segment 30-2 is disposed in the lubricator, full closure elements ("blind rams") in the BOP (50 in FIG. 10) may be closed and any valve(s) on a wellhead (not shown) below the BOP may be closed. Any fluid pressure in the lubricator may then be released, the lubricator disconnected from the BOP (50 in FIG. 10) and the in-well segment 30-2 may be removed from the lubricator for further action.

Figure 11:
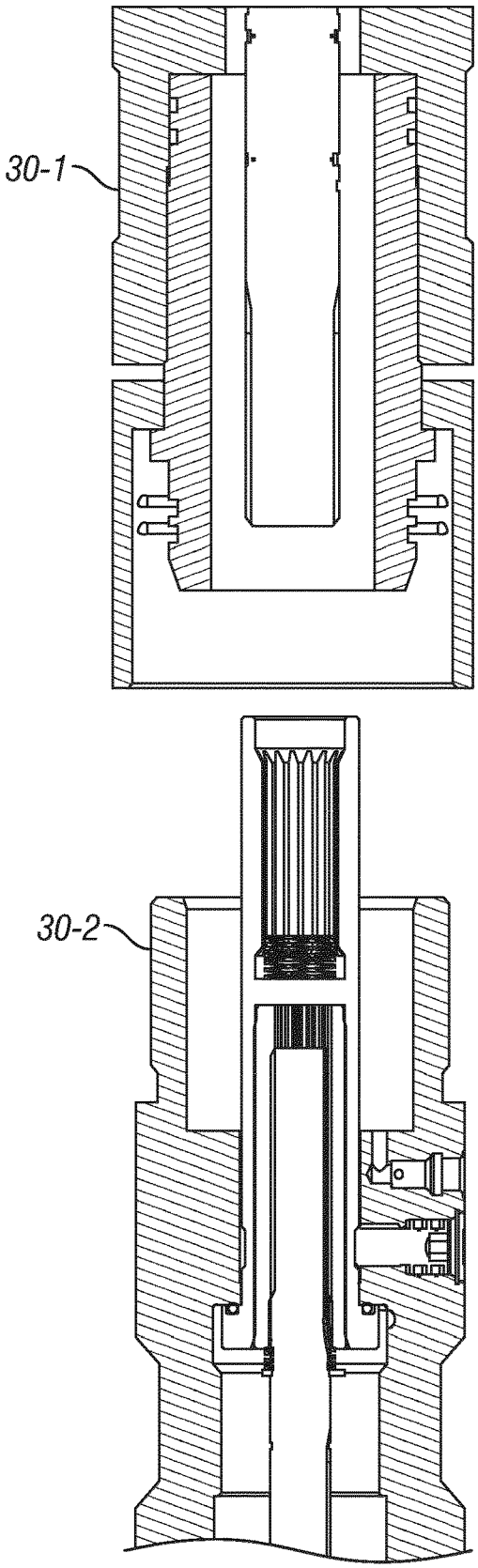
FIG. 11 shows an enlarged schematic view of the segments of the well tool shown in FIG. 10 to illustrate schematically the operation of the functional components during assembly/disassembly.

FIG. 10 shows the in-well segment 30-2 disposed in the BOP 50, wherein the rams or other closure elements 52 are closed about the slick exterior surface 30F to prevent escape of fluid from the well below the BOP 50. The suspended segment 30-1 is shown disposed above the in-well segment for operations as explained with reference to FIGS. 7 through 9A. FIG. 11 shows an enlarged view of the principal components of the pressure control sub corresponding to the same components described with reference to FIGS. 3 through 6.

A pressure control sub according to the present disclosure may be used with well tools assembled from a plurality of longitudinally extending segments such that the well tool may be partially assembled and disassembled while being suspended at the top of a well. Using the pressure control sub as explained herein, well fluid is safely retained within the well at all times. Such assembly and disassembly of a well tool using one or more of such pressure control subs may enable deployment and retrieval of long well tool assemblies without the need for correspondingly long lubricators and vertical clearance above the well to enclose a fully assembled well tool. Such capability may enable deployment and recovery of long well tool assemblies without the need to provide specialized hoisting equipment associated with live well intervention, e.g., "workover rigs."

In light of the principles and examples described and illustrated herein, it will be recognized that the examples can be modified in arrangement and detail without departing from such principles. The foregoing discussion has focused on specific examples, but other configurations are also contemplated. As a rule, any example referenced herein is freely combinable with any one or more of the other examples referenced herein, and any number of features of different examples are combinable with one another, unless indicated otherwise. Those skilled in the art will readily appreciate that many modifications are possible within the scope of the described examples. Accordingly, all such modifications are intended to be included within the scope of this disclosure as defined in the following claims.

The invention claimed is:

1. A multiple segment well tool, comprising:

a first tool segment having a first shaft rotatably supported in a first tool segment housing;

a connector housing releaseably connected at one end to one end of the first tool segment housing;

a second tool segment housing releaseably connected at one end to another end of the connector housing; and wherein the connector housing comprises a piston disposed therein, the piston movable along a longitudinal dimension of the connector housing, the piston comprising internal splines at one end for receiving splines on an exterior of the first shaft, the piston comprising a seal on a face engageable with a shoulder in the connector housing to close the connector housing to fluid flow when the piston is in contact with the shoulder, the piston comprising internal splines at another end for receiving splines on a second shaft rotatably supported in the second tool segment, the piston comprising a spring in the internal splines in the other end whereby coupling the second tool segment to the connector housing causes the shaft in the second tool segment to compress the spring to move the piston and disengage the seal.

2. The well tool of claim 1 further comprising a lock screw disposed through a wall of the connector housing, the lock screw engageable with a groove formed on an exterior surface of the piston, whereby engagement of the lock screw with the piston restrains the piston longitudinally to engage the seal with the shoulder.

3. The well tool of claim 1, further comprising a fluid passage in an interior of the connector housing on one side of the piston extending to the interior of the housing on another side of the piston, the fluid passage comprising a valve to enable selective fluid connection of the one side of the piston to the other side of the piston.

4. The well tool of claim 1, further comprising a connector disposed between the connector housing and the second tool segment, the connector comprising opposed handed threads on opposed longitudinal ends to enable coupling the second tool segment to the connector housing by rotation of the connector.

5. The well tool of claim 1, wherein the first tool segment comprises a well pump.

6. The well tool of claim 1, wherein the second tool segment comprises a well pump protector.

7. The well tool of claim 1, wherein the connector housing comprises a feature on an exterior surface for engagement with a closure element in a well pressure control device.

8. A pressure control sub for a multiple component well tool, comprising:

a connector housing having a connection feature to enable releasable connection at one end to one end of a first tool segment, the connector housing having a connection feature to enable releasable connection at another end to a second tool segment; and wherein the connector housing comprises a piston disposed therein movable along a longitudinal dimension of the connector housing, the piston comprising internal splines at one end for receiving splines on an exterior of a first shaft rotatably supported in the first tool segment, the piston comprising a seal on a face engageable with a shoulder in the connector housing to close the connector housing to fluid flow, the piston comprising internal splines at another end for receiving splines on a second shaft rotatably supported in the second tool segment, the piston comprising a spring in the internal splines in the other end whereby coupling the second tool segment to the connector housing causes the shaft in the second tool segment to compress the spring to move the piston and disengage the seal.

9. The pressure control sub of claim 8 further comprising a lock screw disposed through a wall of the connector housing, the lock screw engageable with a groove formed on an exterior surface of the piston, whereby engagement of the lock screw with the piston restrains the piston longitudinally to engage the seal with the shoulder.

10. The pressure control sub of claim 8, further comprising a fluid passage in an interior of the connector housing on one side of the piston extending to the interior of the housing on another side of the piston, the fluid passage comprising a valve to enable selective fluid connection of the one side of the piston to the other side of the piston.

11. The pressure control sub of claim 8, further comprising a connector disposed between the connector housing and the second tool segment, the connector comprising opposed handed threads on opposed longitudinal ends to enable coupling the second tool segment to the connector housing by rotation of the connector.

12. The pressure control sub of claim 8, wherein the first tool segment comprises a well pump.

13. The pressure control sub of claim 8, wherein the second tool segment comprises a well pump protector.

14. The pressure control sub of claim 8, wherein the connector housing comprises a feature on an exterior surface for engagement with a closure element in a well pressure control device.

15. A method for deploying a multiple segment well tool in a well, comprising:

disposing a first tool segment of the well tool in a lubricator, the first tool segment having a pressure control sub coupled to one end, the pressure control sub comprising a connector housing having a connection feature to enable releasable connection at one end to the one end of the first tool segment, the connector housing having a connection feature to enable releasable connection at another end to a second tool segment, and wherein the connector housing comprises a piston disposed therein movable along a longitudinal dimension of the connector housing, the piston comprising internal splines at one end for receiving splines on an exterior of a shaft in the first tool segment, the piston comprising a seal on a face engageable with a shoulder in the connector housing to close the connector housing to fluid flow, the piston comprising internal splines at another end for receiving splines on a shaft rotatably supported in the second tool segment, the piston comprising a spring in the internal splines in the other end whereby coupling the second tool segment to the connector housing causes the shaft in the second tool segment to compress the spring to move the piston and disengage the seal;

coupling the lubricator to a well pressure control device;

moving the first tool segment until the pressure control sub is disposed in the well pressure control device;

operating a closure element in the well pressure control device;

removing the lubricator from the well pressure control device;

disposing the second tool segment to enable retraction into the lubricator;

lifting the lubricator above the well pressure control device and extending the second tool segment above the pressure control sub;

coupling the second tool segment to the pressure control sub;

coupling the lubricator to the well pressure control device; and opening the closure element.

16. The method of claim 15 further comprising moving the first tool segment, the pressure control sub and the second tool segment to a predetermined depth in the well.

17. The method of claim 16, further comprising:

moving the first tool segment, the pressure control sub and the second tool segment from the predetermined depth so that the pressure control sub is disposed in the closure element;

operating the closure element;

lifting the lubricator from the pressure control device;

uncoupling the second tool segment from the pressure control sub;

coupling the lubricator to the pressure control device;

opening the closure element; and moving the pressure control sub and the first tool segment into the lubricator.

* * * * *